US008821107B2

(12) United States Patent
Lamarque

(10) Patent No.: US 8,821,107 B2
(45) Date of Patent: Sep. 2, 2014

(54) METHOD OF MODIFYING A STEAM TURBINE

(75) Inventor: Frederic Lamarque, Montmorency (FR)

(73) Assignee: ALSTOM Technology Ltd, Baden (CH)

( * ) Notice: Subject to any disclaimer, the term of this patent is extended or adjusted under 35 U.S.C. 154(b) by 566 days.

(21) Appl. No.: 13/250,132

(22) Filed: Sep. 30, 2011

(65) Prior Publication Data

US 2012/0114492 A1 May 10, 2012

(30) Foreign Application Priority Data

Sep. 30, 2010 (FR) ..... 10 57947

(51) Int. Cl.
*F04D 27/02* (2006.01)
*F01D 3/00* (2006.01)
*F01D 5/14* (2006.01)

(52) U.S. Cl.
CPC ..... *F01D 3/00* (2013.01); *F05D 2220/31* (2013.01); *F05D 2230/80* (2013.01); *F01D 5/141* (2013.01); *Y10S 415/912* (2013.01)
USPC ..... 415/1; 415/193; 415/208.2; 415/912

(58) Field of Classification Search
USPC ..... 415/191, 193, 198.1, 199.1, 199.5
See application file for complete search history.

(56) References Cited

U.S. PATENT DOCUMENTS

| | | | |
|---|---|---|---|
| 5,292,230 | A | 3/1994 | Brown |
| 2003/0175117 | A1 | 9/2003 | Klaus et al. |
| 2004/0170497 | A1 | 9/2004 | Snyder et al. |
| 2009/0116957 | A1 | 5/2009 | Wiesenberger |

FOREIGN PATENT DOCUMENTS

| | | | |
|---|---|---|---|
| CN | 1436918 | A | 8/2003 |
| CN | 101057062 | A | 10/2007 |
| FR | 604 508 | A | 5/1926 |
| GB | 230114 | A | 12/1925 |

OTHER PUBLICATIONS

Office Action (First Office Action) issued Dec. 12, 2013, by the Chinese Patent Office in corresponding Chinese Patent Application No. 201010589154.0, and an English Translation of the Office Action. (18 pages).
French Search Report for FR 1057947 dated Apr. 11, 2011.

*Primary Examiner* — Edward Look
*Assistant Examiner* — Michael Sehn

(57) ABSTRACT

A method of modifying a steam turbine to change from a first maximum thermal power of the steam generator to a second maximum thermal power of the steam generator. The method can include replacing, in the high-pressure module, at least one set of fixed blades sized for the first maximum thermal power by at least one set of fixed blades sized for the second maximum thermal power. The at least one set of moving blades are sized to operate at the first and second maximum thermal powers. The rotor and the at least one set of moving blades of the high-pressure module remain unchanged on changing from the first maximum thermal power to the second maximum thermal power.

16 Claims, 3 Drawing Sheets

METHOD OF MODIFYING A STEAM TURBINE

RELATED APPLICATION(S)

This application claims priority under 35 U.S.C. §119 to French Patent Application No. 1057947 filed in France on Sep. 30, 2010, the entire content of which is hereby incorporated by reference in its entirety.

FIELD

The present disclosure relates to a method of modifying a steam turbine, for example, an impulse steam turbine. The method according to the disclosure can make it possible to adapt the turbine to an increase or a decrease in a maximum thermal power of a steam generator feeding the turbine with steam.

BACKGROUND INFORMATION

A steam turbine is a rotating device that converts thermal energy of steam into mechanical energy for driving an electrical generator, a pump, or any other rotary mechanical receiver. A "mechanical receiver" can be a mechanically driven device that absorbs power and performs work.

The turbine can include three modules: a high-pressure module, a medium-pressure module, and at least one low-pressure module. Steam supplied by a steam generator is first routed to the high-pressure module and then to the medium-pressure and low-pressure modules.

The high-pressure module includes a plurality of stages each provided with a set of fixed blades and a set of moving blades installed on a rotor. Each stage has two functions, expanding the steam, which corresponds to converting the thermal energy of the steam into kinetic energy, and converting the kinetic energy into mechanical energy by the set of moving blades.

A turbine can be sized for a maximum thermal power of the steam generator. It may be required to increase this maximum thermal power, for example, if it is desired to increase the electrical power supplied by the electrical generator driven by the turbine. In this case there is a change from a lower maximum thermal power to a higher maximum thermal power. The turbine should, then be adapted to this increased maximum thermal power.

To do this it is known to modify the active parts of the turbine to accept a greater steam flow rate. The active parts of the turbine are the parts allowing the steam to expand, for example, the sets of fixed blades and the sets of moving blades attached to the rotor.

This process can be long and costly, as it can involve changing the rotor with its moving blades and the sets of fixed blades.

A second method includes anticipating an increase in maximum thermal power and designing the turbine accordingly, for example, by designing the turbine for the higher maximum thermal power and providing a device for limiting the steam flow rate to operate at a lower maximum thermal power. In a first variant of this second method, it is possible to operate at the lower maximum thermal power by limiting the overall steam flow rate by steam inlet valves. In a second variant of this method, it is possible to operate at the lower maximum thermal power by reducing the steam flow rate through one sector of the first set of fixed blades of the high-pressure module.

This second method can reduce the efficiency of the turbine.

SUMMARY

A method of modifying a steam turbine is disclosed, to enable the turbine to be adapted to change from a first (specified) maximum thermal power of a steam generator that generates steam to a second (specified) maximum thermal power of the steam generator different than the first maximum thermal power, the turbine having a high-pressure module comprising at least one set of fixed blades and a rotor supporting at least one set of moving blades, the method including replacing in the high-pressure module, at least one first set of fixed blades sized for the first maximum thermal power by at least one second set of fixed blades sized for the second maximum thermal power; and sizing the at least one set of moving blades to operate at the first and second maximum thermal powers, the rotor and the at least one set of moving blades of the high-pressure module remain unchanged on changing from the first maximum thermal power to the second maximum thermal power.

Interchangeable turbine blades are disclosed for installation in a steam turbine having a first set of fixed blades configured for a first maximum thermal power of a high-pressure module of a steam generator, the interchangeable turbine blades comprising: a second set of fixed blades, sized to replace the first set of fixed blades, but configured for a second maximum thermal power of the steam generator which is different than the first maximum thermal power; wherein the second set of fixed blades are sized for operating in the high-pressure module with a same set of moving blades on a rotor of the high-pressure module as the first set of blades which they are to replace.

BRIEF DESCRIPTION OF THE DRAWINGS

Other features and advantages of the present disclosure will become more apparent on reading the following description given by way of illustrative and non-limiting example with reference to the appended drawings, in which.

DETAILED DESCRIPTION

Figure 1:
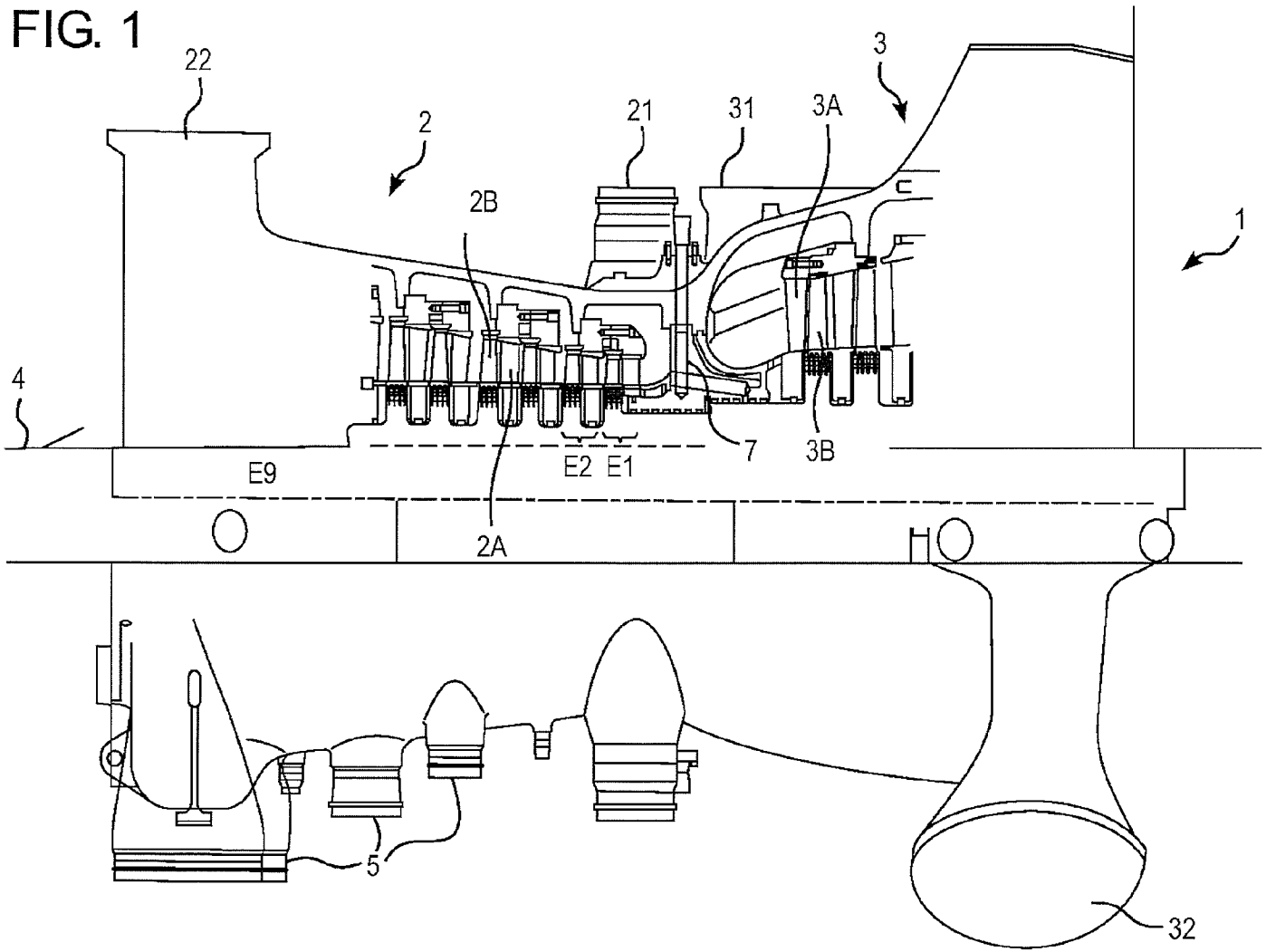
FIG. 1 is a view in partial longitudinal section of a high-pressure module and a low-pressure module of a steam turbine subjected to a method according to an exemplary embodiment of the disclosure.

The disclosure relates to exemplary methods of allowing a turbine to be adapted to a change from a first maximum thermal power, for example, a desired specified lower maximum thermal power of the steam generator, to a second maximum thermal power, for example, a desired specified higher maximum thermal power of the steam generator, with few changes of parts, in a short time period. The method can preserve a satisfactory efficiency for the two maximum thermal powers. The method according to the disclosure can make it possible to carry out the adaptation of the turbine during a normal maintenance period of a power station, which can be of the order of two weeks.

An exemplary embodiment of the disclosure relates to a method of modifying a steam turbine, where steam is generated by a steam generator. The method can enable the turbine to be adapted to the change from a first maximum (i.e., first specified) thermal power of the steam generator to a second maximum (i.e., second specified) thermal power of the steam generator. The turbine can include a high-pressure module including at least one set of fixed blades and a rotor supporting at least one set of moving blades.

An exemplary embodiment of the disclosure relates to the replacement, in the high-pressure module, of at least one set of fixed blades sized for the first maximum thermal power by at least one set of fixed blades sized for the second maximum thermal power. The set or sets of moving blades can be sized to operate at the first and second maximum thermal powers. The rotor and the set or sets of moving blades of the high-pressure module remain unchanged on changing from the first maximum thermal power to the second maximum thermal power.

The use of sets of moving blades pre-sized to operate at the two maximum thermal powers can make it possible to avoid changing the rotor at the same time as preserving a satisfactory efficiency for the two maximum thermal powers. Moreover, replacing at least one set of fixed blades in the high-pressure module, without changing its height, makes it possible to adapt the turbine to the increased or decreased maximum thermal power.

The set or sets of moving blades can be sized to withstand the mechanical stresses associated with each of the first and second maximum thermal powers and so that, for each stage of the high-pressure module, the combination including the set of moving blades and the set of fixed blades can be adapted from a thermo-aerodynamic point of view to the first and second maximum thermal powers.

Each set of fixed blades sized for the second maximum thermal power, replacing a set of fixed blades sized for the first maximum thermal power, can be a set of fixed blades allowing the passage of a flow of steam a) higher than the replaced set of fixed blades, if the first maximum thermal power is a lower maximum thermal power and the second maximum thermal power is a higher maximum thermal power, or b) lower than the replaced set of fixed blades if the first maximum thermal power is a higher maximum thermal power and the second maximum thermal power is a lower maximum thermal power.

Each set of fixed blades adapted to the second maximum thermal power, replacing a set of fixed blades sized for the first maximum thermal power, can include blades oriented relative to each other so that the steam flow area between two adjacent blades can be a) greater than the steam flow area between two adjacent blades of the replaced set of fixed blades if the first maximum thermal power is a lower maximum thermal power and the second maximum thermal power is a higher maximum thermal power or b) less than the steam flow area between two adjacent blades of the replaced set of fixed blades if the first maximum thermal power is a higher maximum thermal power and the second maximum thermal power is a lower maximum thermal power.

A method according to an exemplary embodiment of the disclosure includes modifying a turbine including a medium-pressure module coupled to the high-pressure module, the medium-pressure module including at least one set of fixed blades and at least one set of moving blades attached to the rotor of the high-pressure module. In this case the method can include limiting the sum of: a) the resultant thrust exerted on the rotor and generated by the pressure differences between the inlet and the outlet of each set of moving blades in the high-pressure module; and b) the resulting thrust exerted on the rotor and generated by the pressure differences between the inlet and the outlet of each set of moving blades in the medium-pressure module.

Limiting the sum of the resulting thrusts on the rotor can include injecting steam onto a thrust surface of the rotor substantially orthogonal to the axis of the rotor. The thrust surface may delimited by a change of rotor diameter.

The steam turbine can be an impulse turbine. There can be two categories of steam turbines, often combined in the same machine. On the one hand, there are impulse turbines in which expansion occurs mostly (for example at least 85%) in the sets of fixed blades. The second category of steam turbines includes reaction turbines, in which expansion is divided between the sets of fixed and moving blades. The degree of reaction is defined by the distribution of the expansion between the sets of blades.

As shown in FIG. 1, a steam turbine 1 according to an exemplary embodiment of the disclosure, includes a high-pressure module 2 combined with a medium-pressure module 3, also called a combined high-pressure/medium-pressure body. The high-pressure module 2 and the medium-pressure module 3 can also be separate. Steam from a steam generator passes successively through the high-pressure module 2 and the medium-pressure module 3. Steam enters the high-pressure module 2 via an inlet pipe 21 of the high-pressure module 2 and leaves it via an outlet pipe 22. The steam is then directed to the medium-pressure module 3 via an inlet pipe 31 and leaves the medium-pressure module 3 via an outlet pipe 32.

The high-pressure module 2 includes a plurality of stages. In the exemplary embodiment shown in FIG. 1, the high-pressure module 2 includes nine stages E1 to E9. Any number of stages can be used, however. Each stage includes a set 2A of fixed blades and a set 2B of moving blades. The sets 2B of moving blades are installed on a rotor 4 and enable the rotor 4 to be driven in rotation by the kinetic energy of the steam that has passed through the sets 2A of fixed blades.

Bleed pipes 5 can bleed steam to direct it to a water-heating station which makes it possible to increase the efficiency of the installation.

In the same way, the medium-pressure module 3 includes a plurality of stages each having a set 3A of fixed blades and a set 3B of moving blades attached to the rotor 4. The medium-pressure module 3 also includes bleed pipes.

A method according to an exemplary embodiment of the disclosure makes it possible to adapt the turbine 1 to the change from a first maximum thermal power of the steam generator to a second maximum thermal power of the steam generator, for example, from a lower maximum thermal power to a higher maximum thermal power or vice-versa.

To this end, a turbine 1 is used in which the sets 2B of moving blades of the high-pressure module 2 are sized to operate either at the first maximum thermal power or at the second maximum thermal power.

The sets 2B of moving blades can thus be sized, to withstand equally well, mechanical stresses associated with the first maximum thermal power and mechanical stresses associated with the second maximum thermal power, and so that in each stage of the high-pressure module the combination of the set 2B of moving blades and the set 2A of fixed blades is adapted from a thermo-aerodynamic point of view (for example, by its profile or its position) to the first maximum thermal power and the second maximum thermal power.

To adapt the sets of moving blades to the mechanical stresses linked to the two extreme thermal powers, there are determined the profile, dimensions, material, structure and functional characteristics most suitable for the forces (for example, centrifugal forces) liable to be applied to these sets of blades during operation.

To optimize efficiency, the profiles and the sizes of the set 2A of moving blades can be chosen as a function of those of the set 2B of fixed blades, their sizes and relative disposition having to enable optimum operation of the aforementioned combination whatever the thermal power.

To operate at the two maximum thermal powers, the set 2B of moving blades and the set 2A of fixed blades can be sized by controlling in each stage of the turbine 1 the steam enthalpy drop and the degree of reaction, so that the steam enthalpy drop and the degree of reaction satisfy the ranges of adaptation of the sets of blades for the two specified maximum thermal powers. For example, for each maximum thermal power there can be an optimum value of the steam enthalpy drop and the degree of reaction, and there can be taken as a value suited to both powers, a function of the two optimum values (for example, the mean or other mathematical function).

A method according to an exemplary embodiment of the disclosure can include replacing, in the high-pressure module 2, at least one set 2A of fixed blades so that it is sized, notably by its profile, for the specified maximum thermal power, for example, the higher maximum thermal power if the turbine was previously operating at a lower maximum thermal power or vice-versa.

This replacement can be effected in the first stages of the high-pressure module 2. The number of sets 2A of fixed blades to be replaced can be a function of the difference between the first maximum thermal power and the second maximum thermal power.

According to one exemplary embodiment, the blades of the sets replaced can be adjusted. To be more precise, the blades of the sets 2A of fixed blades in question can be oriented so as to increase the steam flow area in the sets 2A of fixed blades for a higher maximum thermal power, or to decrease the steam flow area in the sets 2A of fixed blades for a lower maximum thermal power.

Figure 2A:
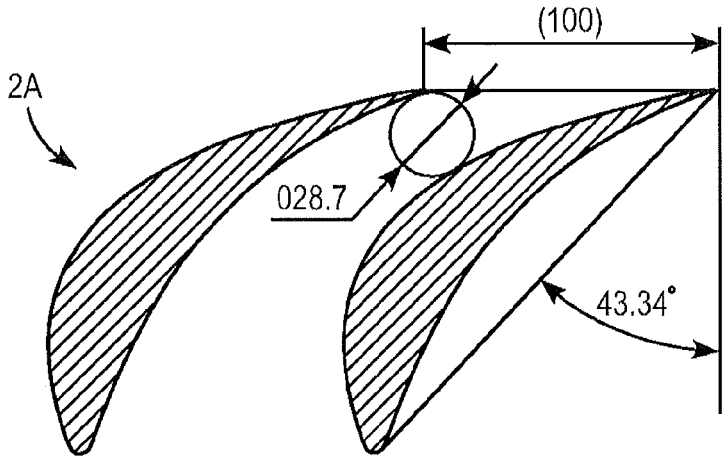
FIGS. 2A to 2C show different orientations of an exemplary set of fixed blades of a turbine.
Figure 2B:
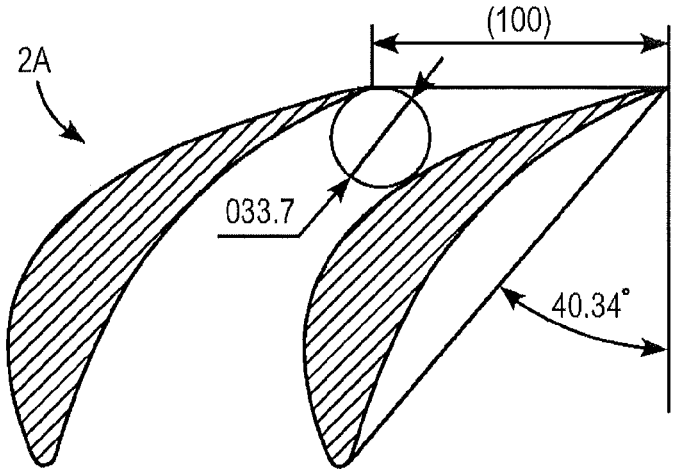
Figure 2C:
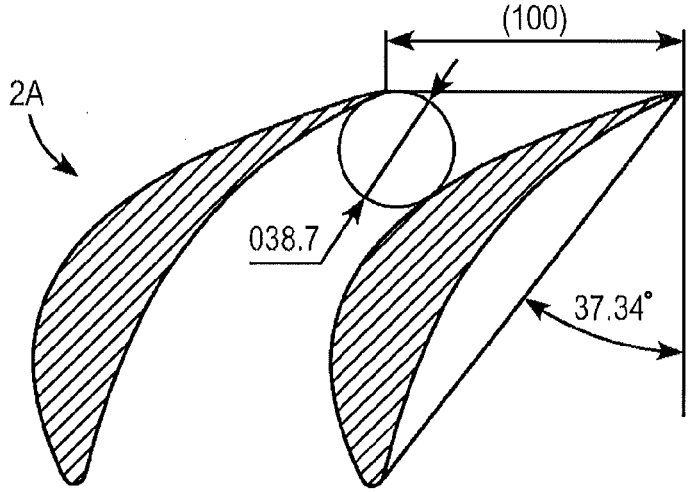

Thus FIGS. 2A and 2B show two possible orientations of a set 2A of fixed blades sized for the lower maximum thermal power and FIG. 2C shows one possible orientation of a set 2A of fixed blades sized for the higher maximum thermal power. The dimensions are given in centimeters. Note that the set 2A of fixed blades adapted to the higher maximum thermal power include adjacent blades oriented relative to each other so that the steam flow area between the two blades is larger (FIG. 2C) than the steam flow area between the adjacent blades of the set 2A of fixed blades adapted to the lower maximum thermal power (FIGS. 2A and 2B).

The pressure differences between the inlets and the outlets of the sets 2B of moving blades in each high-pressure module 2 and low-pressure module 3 generate a resultant thrust on the rotor 4. On changing from the first maximum thermal power, for example, the lower one, to the second maximum thermal power, for example, the higher one, the sum of these two thrusts should balance, for example, they should be limited to a threshold value, so as not to damage the rotor 4.

Figure 3:
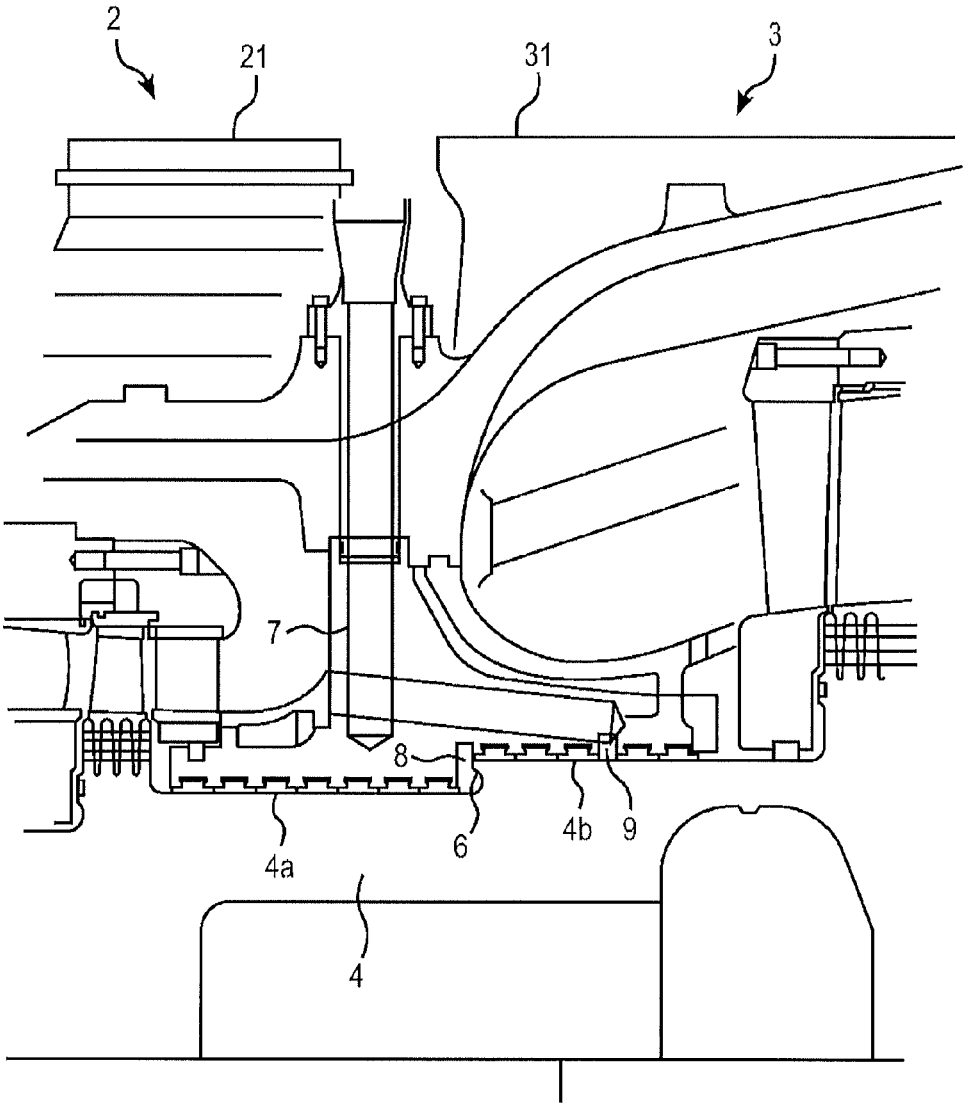
FIG. 3 is a partial view of the exemplary turbine from FIG. 1.

To this end, and as shown in FIG. 3, which shows a detail from FIG. 1, steam is routed from a bleed pipe 5 (shown in FIG. 1) of the high-pressure module 2 to a thrust surface 6 of the rotor 4 via a pipe 7. The thrust surface 6 can be, for example, located between the high-pressure module 2 and the medium-pressure module 3 in the central part of the body in the case of a combined high-pressure/medium-pressure body. The thrust surface 6 can be substantially orthogonal to the axis of the rotor 4 and can be located between an area 4*a* and an area 4*b* of the rotor 4 delimiting the high-pressure module 2 from the medium-pressure module 3, the area 4*b* being an area of the rotor 4 of greater diameter than the area 4*a*. Thus, the thrust surface 6 is subjected to the pressure of a bleed from the high-pressure module 2, which can make it possible to limit the resulting thrust on the rotor 4.

The steam leaving the pipe 7 is then directed toward a chamber 8 while a chamber 9 collects the steam and limits steam leaks.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method of modifying a steam turbine, to enable the turbine to be adapted to change from a first maximum thermal power of a steam generator that generate steams to a second maximum thermal power of the steam generator different than the first maximum thermal power, the turbine including a high-pressure module having at least one set of fixed blades and a rotor supporting at least one set of moving blades, the method comprising:

replacing, in the high-pressure module, at least one first set of fixed blades sized for the first maximum thermal power by at least one second set of fixed blades sized for the second maximum thermal power; and sizing the at least one set of moving blades to operate at the first and second maximum thermal powers, the rotor and the at least one set of moving blades of the high-pressure module remaining unchanged on changing from the first maximum thermal power to the second maximum thermal power.

2. The method according to claim 1, comprising:

sizing the at least one set of moving blades to withstand mechanical stresses associated with the first and second maximum thermal powers so that, for each stage of the high-pressure module, a combination of the set of moving blades and the second set of fixed blades will be thermo-aerodynamically adapted to the first and second maximum thermal powers.

3. The method according to claim 1, wherein each second set of fixed blades sized for the second maximum thermal power replacing the first set of fixed blades sized for the first maximum thermal power comprises:

a set of fixed blades allowing passage of a flow of steam: a) higher than the first set of fixed blades if the first maximum thermal power is a lower maximum thermal power and the second maximum thermal power is a higher maximum thermal power; or b) lower than the first set of fixed blades if the first maximum thermal power is a higher maximum thermal power and the second maximum thermal power is a lower maximum thermal power.

4. The method according to claim 1, wherein each second set of fixed blades adapted to the second maximum thermal power replacing the first set of fixed blades sized for the first maximum thermal power comprises:

blades oriented relative to each other so that a steam flow area between two adjacent blades is: a) greater than a steam flow area between two adjacent blades of the first set of fixed blades if the first maximum thermal power is a lower maximum thermal power and the second maximum thermal power is a higher maximum thermal power; or b) less than the steam flow area between two adjacent blades of the first set of fixed blades if the first maximum thermal power is a higher maximum thermal power and the second maximum thermal power is a lower maximum thermal power.

5. The method according to claim 1, comprising:

coupling a medium-pressure module to the high-pressure module, the medium-pressure module comprising at least one set of fixed blades and at least one set of moving blades attached to the rotor of the high-pressure module; and limiting a sum of a) a resultant thrust exerted on the rotor and generated by a pressure difference between an inlet and an outlet of each set of moving blades in the high-pressure module, and b) a resulting thrust exerted on the rotor and generated by a pressure difference between an inlet and an outlet of each set of moving blades in the medium-pressure module.

6. The method according to claim 5, wherein limiting the sum of the resulting thrusts on the rotor comprises:

injecting steam onto a thrust surface of the rotor substantially orthogonal to an axis of the rotor.

7. The method according to claim 6, wherein the thrust surface is delimited by a change of diameter of the rotor.

8. The method according to claim 1, wherein the steam turbine is an impulse turbine.

9. The method according to claim 2, wherein each second set of fixed blades sized for the second maximum thermal power replacing the first set of fixed blades sized for the first maximum thermal power comprises:

a set of fixed blades allowing a passage of a flow of steam: a) higher than the first set of fixed blades if the first maximum thermal power is a lower maximum thermal power and the second maximum thermal power is a higher maximum thermal power; or b) lower than the first set of fixed blades if the first maximum thermal power is a higher maximum thermal power and the second maximum thermal power is a lower maximum thermal power.

10. The method according to claim 2, wherein each second set of fixed blades adapted to the second maximum thermal power replacing the first set of fixed blades sized for the first maximum thermal power comprises:

blades oriented relative to each other so that a steam flow area between two adjacent blades is: a) greater than a steam flow area between two adjacent blades of the first set of fixed blades if the first maximum thermal power is a lower maximum thermal power and the second maximum thermal power is a higher maximum thermal power; or b) less than the steam flow area between two adjacent blades of the first set of fixed blades if the first maximum thermal power is a higher maximum thermal power and the second maximum thermal power is a lower maximum thermal power.

11. The method according to claim 3, wherein each second set of fixed blades adapted to the second maximum thermal power replacing the first set of fixed blades sized for the first maximum thermal power comprises:

blades oriented relative to each other so that a steam flow area between two adjacent blades is: a) greater than a steam flow area between two adjacent blades of the first set of fixed blades if the first maximum thermal power is a lower maximum thermal power and the second maximum thermal power is a higher maximum thermal power; or b) less than the steam flow area between two adjacent blades of the first set of fixed blades if the first maximum thermal power is a higher maximum thermal power and the second maximum thermal power is a lower maximum thermal power.

12. The method according to claim 2, comprising:

coupling a medium-pressure module to the high-pressure module, the medium-pressure module comprising at least one set of fixed blades and at least one set of moving blades attached to the rotor of the high-pressure module; and limiting the sum of a) a resultant thrust exerted on the rotor and generated by a pressure difference between an inlet and an outlet of each set of moving blades in the high-pressure module, and b) a resulting thrust exerted on the rotor and generated by a pressure difference between an inlet and an outlet of each set of moving blades in the medium-pressure module.

13. The method according to claim 3, comprising:

coupling a medium-pressure module to the high-pressure module, the medium-pressure module comprising at least one set of fixed blades and at least one set of moving blades attached to the rotor of the high-pressure module; and limiting the sum of a) a resultant thrust exerted on the rotor and generated by a pressure difference between an inlet and an outlet of each set of moving blades in the high-pressure module, and b) a resulting thrust exerted on the rotor and generated by a pressure difference between an inlet and an outlet of each set of moving blades in the medium-pressure module.

14. The method according to claim 4, comprising:

coupling a medium-pressure module to the high-pressure module, the medium-pressure module comprising at least one set of fixed blades and at least one set of moving blades attached to the rotor of the high-pressure module; and limiting the sum of a) a resultant thrust exerted on the rotor and generated by a pressure difference between an inlet and an outlet of each set of moving blades in the high-pressure module, and b) a resulting thrust exerted on the rotor and generated by a pressure difference between an inlet and an outlet of each set of moving blades in the medium-pressure module.

15. Interchangeable turbine blades for installation in a steam turbine having a first set of fixed blades configured for a first maximum thermal power of a high-pressure module of a steam generator, the interchangeable turbine blades comprising:

a second set of fixed blades, sized to replace the first set of fixed blades, but configured for a second maximum thermal power of the steam generator which is different than the first maximum thermal power;

wherein the second set of fixed blades are sized for operating in the high-pressure module with a same set of moving blades on a rotor of the high-pressure module as the first set of blades which they are to replace.

16. The interchangeable blades of claim 15, in combination with:

a steam turbine having a high-pressure module with a rotor supporting at least one set of mixing blades sized to operate at both of the specified first and second maximum thermal powers.

* * * * *